US008240723B2

(12) United States Patent
Akahori et al.

(10) Patent No.: US 8,240,723 B2
(45) Date of Patent: Aug. 14, 2012

(54) DOOR LATCH APPARATUS FOR VEHICLE

(75) Inventors: Masakazu Akahori, Yokohama (JP); Ryoji Shimura, Yokohama (JP)

(73) Assignee: Mitsui Kinzoku Act Corporation, Yokohama-shi (JP)

( * ) Notice: Subject to any disclaimer, the term of this patent is extended or adjusted under 35 U.S.C. 154(b) by 1075 days.

(21) Appl. No.: 12/155,464

(22) Filed: Jun. 4, 2008

(65) Prior Publication Data

US 2009/0001734 A1 Jan. 1, 2009

(30) Foreign Application Priority Data

Jun. 27, 2007 (JP) ..... 2007-168382

(51) Int. Cl.
*E05C 3/16* (2006.01)
*E05C 3/06* (2006.01)

(52) U.S. Cl. ..... 292/216; 292/201; 292/DIG. 23; 292/DIG. 65

(58) Field of Classification Search ..... 292/216, 292/201, DIG. 23, DIG. 65
See application file for complete search history.

(56) References Cited

U.S. PATENT DOCUMENTS 4,508,379 A * 4/1985 Mochida ..... 292/336.3
4,913,477 A * 4/1990 Watanuki et al. ..... 292/216
4,929,007 A * 5/1990 Bartczak et al. ..... 292/336.3
5,186,504 A * 2/1993 Takaishi et al. ..... 292/216
5,273,324 A * 12/1993 Kobayashi ..... 292/201
5,427,421 A * 6/1995 Hamaguchi ..... 292/216
5,531,488 A * 7/1996 Yoshikuwa et al. ..... 292/216
7,810,853 B2 * 10/2010 Margheritti ..... 292/216

FOREIGN PATENT DOCUMENTS

JP 57-189018 U 11/1982
JP 2003-013648 1/2003
JP 2006-063574 3/2006

* cited by examiner

*Primary Examiner* — Carlos Lugo
(74) *Attorney, Agent, or Firm* — Foley & Lardner LLP

(57) ABSTRACT

A door latch apparatus for a vehicle includes: a base member fixed in a door by a plurality of bolts; an engagement mechanism supported by the base member, and arranged to be engaged with a striker of a vehicle body; and an outside lever pivotably supported by the base member, and connected through an operating force transmitting member to an outside handle provided to an outer door panel of the door, the outside lever being pivoted in accordance with an operation of the outside handle so as to release the engagement between the engagement mechanism and the striker, the outside lever including a connection portion connected with the operating force transmitting member, and disposed in a region inside of the outer edge of the base member in the lateral direction of the vehicle.

4 Claims, 3 Drawing Sheets

DOOR LATCH APPARATUS FOR VEHICLE

BACKGROUND OF THE INVENTION

This invention relates to a door latch apparatus for a vehicle which includes an outside lever connected through an operating force transmitting member to an outside handle provided on an outer door panel of a door.

Published Japanese Patent Application Publication No. 2003-13648 and No. 2006-63574 show door latch apparatuses for a vehicle each of which includes a base member fixed within a door near an inner door panel; an engagement mechanism supported by the base member, and arranged to be engaged with a striker on a vehicle body when the door is closed; an outside lever provided to the base member, and connected through an operating force transmitting member to an outside handle provided on an outer door panel of the door; and other levers provided to the base member.

SUMMARY OF THE INVENTION

In the door latch apparatuses described above, the outside lever is pivotably mounted to the base member fixed within the door near the inner door panel, and connected through the operating force transmitting member to the outside handle provided to the outer door panel of the door. A connection portion of the outside lever which is connected with the operating force transmitting member protrudes beyond a side end portion or outer edge of the base member toward the outer door panel. Accordingly, in a case in which the outer door panel is deformed toward the inside of the vehicle by the accident and so on, the external load by the door deformation acts directly to the outside lever, and may cause mechanical malfunction by the deformation of the outside lever.

It is, therefore, an object of the present invention to provide a door latch apparatus for a vehicle which is devised so as not to cause mechanical malfunction of an outside lever even when an outer door panel of a door is deformed.

According to one aspect of the present invention, a door latch apparatus for a vehicle, the door latch apparatus comprises: a base member fixed in a door by a plurality of bolts, the base member having a surface extending in a lateral direction of the vehicle from an outer edge to an inner edge; an engagement mechanism supported by the base member, and arranged to be engaged with a striker of a vehicle body; and an outside lever pivotably supported by the base member, and connected through an operating force transmitting member to an outside handle provided to an outer door panel of the door, the outside lever being pivoted in accordance with an operation of the outside handle so as to release the engagement between the engagement mechanism and the striker, the outside lever including a connection portion connected with the operating force transmitting member, and disposed in a region inside of the outer edge of the base member in the lateral direction of the vehicle.

DETAILED DESCRIPTION OF THE INVENTION

Hereinafter, an embodiment according to the present invention will be illustrated with reference to the drawings.

Figure 1:
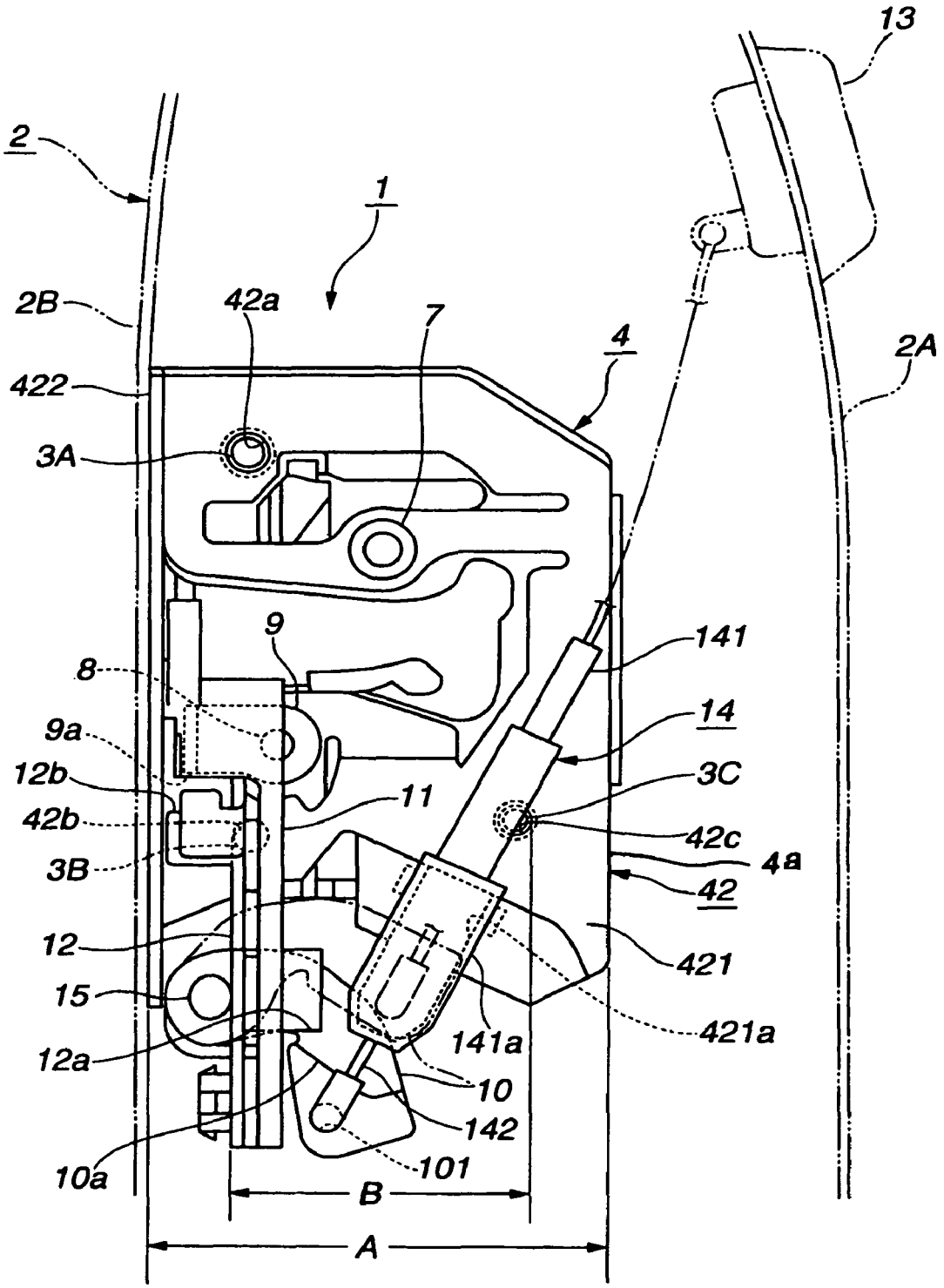
FIG. 1 is a front view showing a door latch apparatus according to one embodiment of the present invention.
Figure 2:
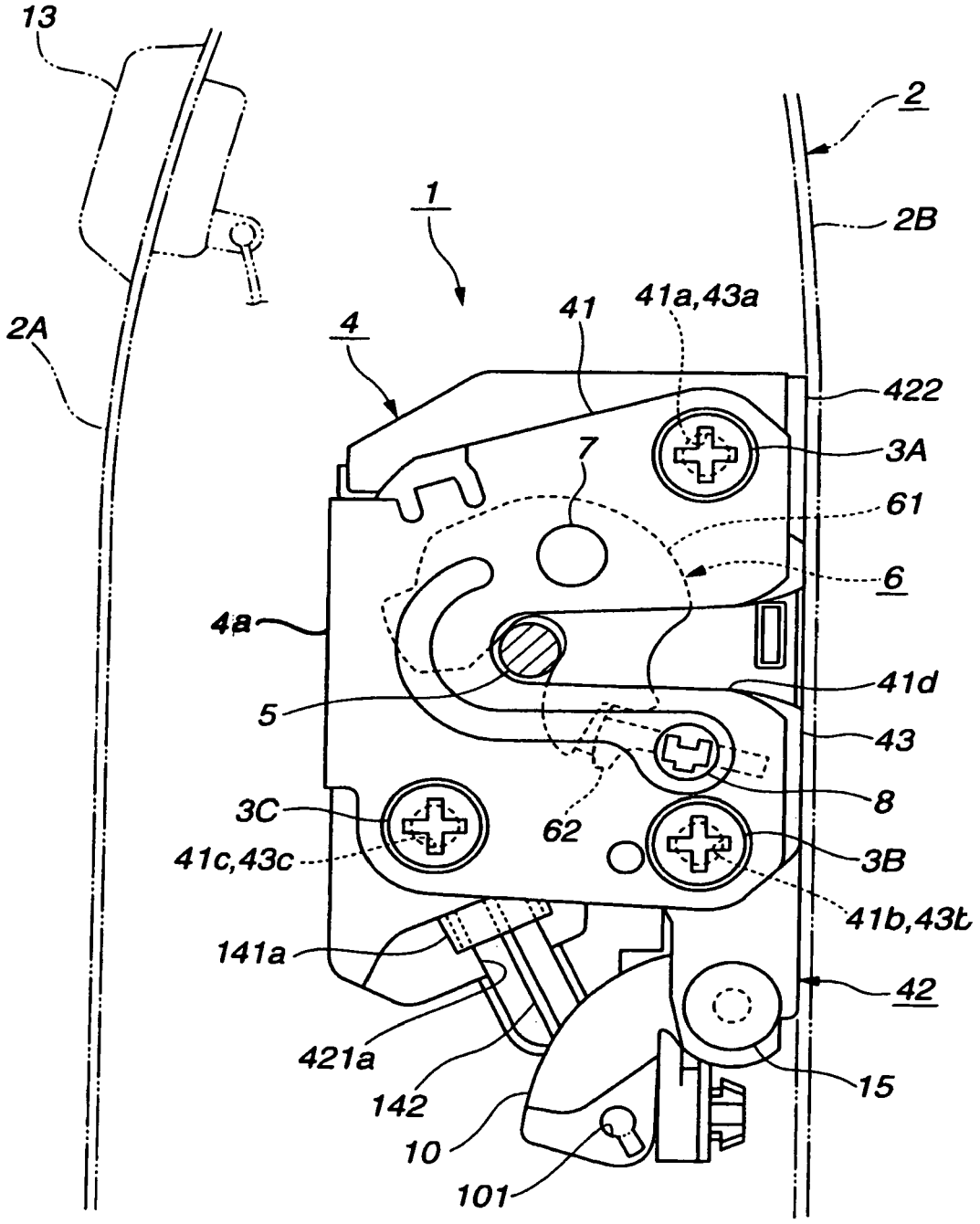
FIG. 2 is a back view showing the door latch apparatus of FIG. 1.
Figure 3:
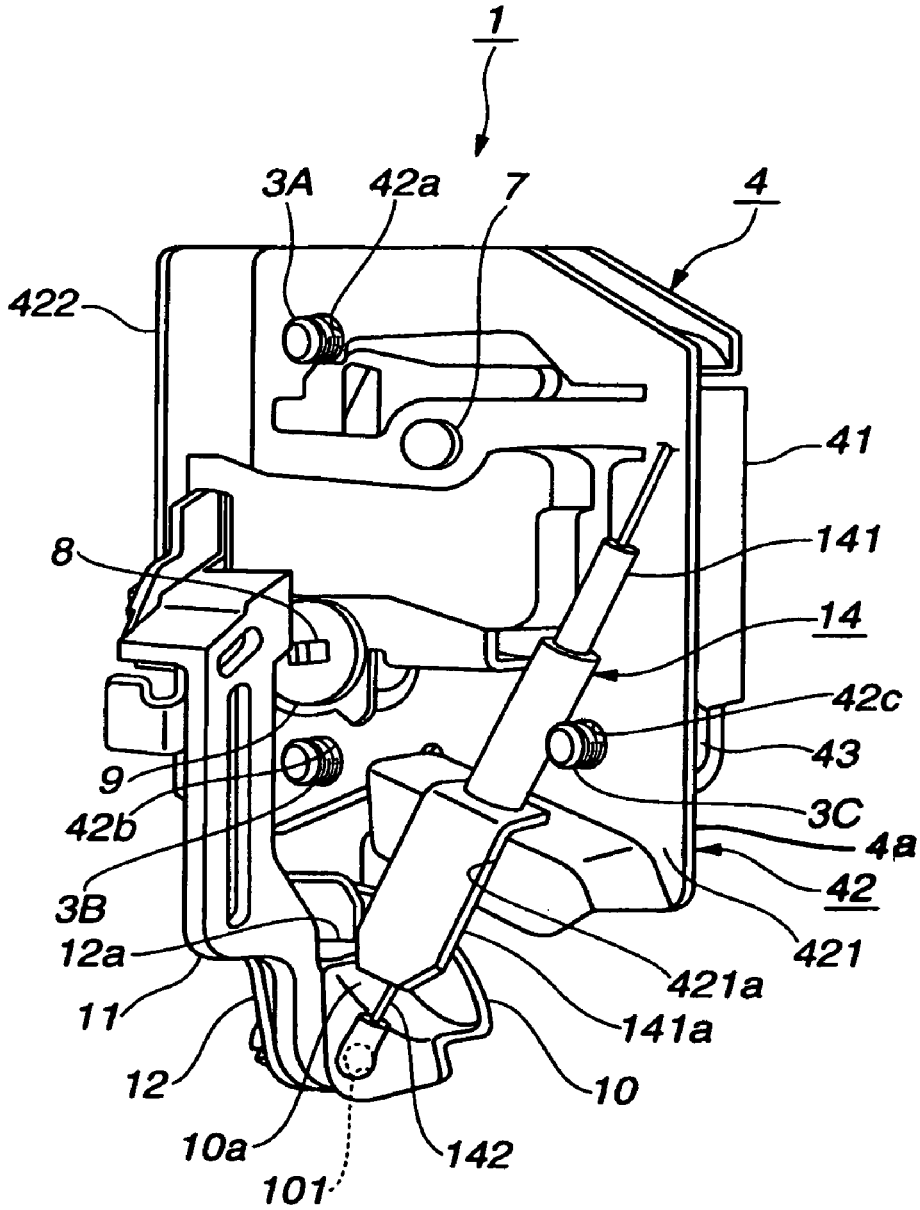
FIG. 3 is a perspective view of the door latch apparatus of FIG. 1 as viewed obliquely from front.

FIG. 1 is a front view showing a door latch apparatus according to the embodiment of the present invention. FIG. 2 is a back view showing the door latch apparatus of FIG. 1. FIG. 3 is a perspective view showing the door latch apparatus of FIG. 1 as viewed obliquely from front. Hereinafter, a leftward direction in FIG. 1 and a rightward direction in FIG. 2 correspond to an inside of a vehicle. A front side of FIG. 1 and a back side of FIG. 2 correspond to a forward direction of the vehicle. A back side of FIG. 1 and a front side of FIG. 2 correspond to a rearward direction of the vehicle.

A door latch apparatus 1 includes a base member 4 fixed on a rear end surface within a door 2 pivotably supported on a vehicle body to be opened and closed, by a plurality of bolts 3A~3C (three bolts in this example) for fixing to door 2, and extending in the forward direction; an engagement mechanism or section 6 supported within base member 4, and arranged to hold door 2 in a closed state by engaging with a striker 5 fixed on the vehicle body; an open lever 9, an outside lever 10, first and second sub levers 11 and 12, an inside lever and other levers provided on a front surface side of base member 4. The inside lever and the other levers do not relate to the present invention, and the detailed illustrations and the drawings are omitted.

Door 2 includes an outer door panel 2A on the outside of the vehicle (the right side in FIG. 1), and an inner door panel 2B on the inside of the vehicle (the left side in FIG. 1). Outer door panel 2A is provided with an outside handle 13 operated or manipulated when door 2 is opened from the outside. Inner door panel 2B is provided with an inside handle (not shown) operated or manipulated when door 2 is opened from the inside. Outside handle 13 is connected to outside lever 10 through a Bowden cable 14 extending in the upward and downward directions, and serving as an operating force transmitting member for transmitting the operating force. It is optional to employ, as the operating force transmitting member, a rod, a connection plate extending in the forward and rearward directions, and so on, in place of Bowden cable 14.

Bowden cable 14 includes a flexible conduit or pipe 141, and an inner cable 142 slidably inserted within pipe 141. A holder portion 141*a* is formed in a lower end portion of pipe 141, and fixed on a base plate 42 described later. An upper end portion of inner cable 142 is connected with outside handle 13, and a lower end portion of inner cable 142 is connected with outside lever 10.

Base member 4 includes a cover plate 41 and base plate 42 made from metal, and fixed by bolts 3A~3C on the rear end surface formed (extending) within door 2 in the inside and outside directions (lateral direction) of the vehicle, nearer to inner door panel 2B than to outer door panel 2A; and a body 43 made from synthetic resin, and sandwiched between cover plate 41 and base plate 42 in the forward and rearward directions of the vehicle.

Cover plate 41 confronts the rear end surface of door 2. Cover plate 41 is formed with a striker insertion groove 41*d* into which striker 5 is inserted when door 2 is closed. Cover plate 41 is formed with bolt through holes 41*a*~41*c* into which bolts 3A~3C are inserted respectively, and which penetrate in the forward and rearward directions. Body 43 is formed with bolt through holes 43*a*~43*c* into which bolts 3A~3C are inserted respectively, and which penetrate in the forward and rearward directions. Base plate 42 is formed with thread holes 42*a*~42*c* into which bolts 3A~3C are screwed respectively.

Base plate 42 has a surface extending in the lateral direction of the vehicle from an outer edge 4*a* or outer end portion (on the right side in FIG. 1) extending in the upward and downward directions, to an inner edge or inner end portion (on the left side in FIG. 1) extending in the upward and downward directions. Upper and lower thread holes 42*a* and 42*b* are formed on the inner door panel 2B's side of base plate 42. That is, upper and lower thread holes 42*a* and 42*b* are formed at positions which are nearer to the inner edge of base plate 42 than to the outer edge 4*a* of base plate 42. Upper and lower holes 42*a* and 42*b* correspond to inner engagement portions. Thread hole 42*c* is formed on the outer door panel 2A's side of base plate 42. That is, thread hole 42*c* is formed at a position which is nearer to the outer edge 4*a* of base plate 42 than to the inner edge of the base plate 42. Thread hole 42*c* corresponds to an outer engagement portion.

Base plate 42 is bent in a substantially L-shape in a plan view. Base plate 42 includes a first base portion 421 extending substantially parallel with the inside and outside directions of the vehicle of door 2; and a second base portion 422 extending substantially parallel with inner door panel 2B. First base portion 421 includes a cable fixing portion 421*a* which is formed in a lower portion of first base portion 421, and which is a cutout shape. Cable fixing portion 421*a* is for fixing holder portion 141*a* of pipe 141 of Bowden cable 14. Cable fixing portion 421*a* is located within a region A (within width of base plate 42 in the inside and outside directions or the lateral direction of the vehicle) inside of the outer edge 4*a* of base plate 42 in the lateral direction of the vehicle, in the front view as shown in FIG. 1. Moreover, cable fixing portion 421*a* is formed within an engagement region B between thread hole 42*b* on the inside of base plate 42 in the lateral direction and thread hole 42*c* on the outside of base plate 42 in the lateral direction in region A, in the front view as shown in FIG. 1. Consequently, holder portion 141*a* is fixed within engagement region B between thread hole 42*b* in the inner portion of base plate 42 in the lateral direction and thread hole 42*c* in the outer portion of base plate 42 in the lateral direction.

Engagement mechanism 6 includes a latch 61 which is disposed within body 43, which is pivotably supported by a supporting shaft 7 extending in the forward and rearward direction between cover plate 41 and base plate 42, and which is arranged to be engaged with striker 5 inserted into striker insertion groove 41*d*; and a ratchet 62 which is pivotably supported by a supporting shaft 8 in the same manner as latch 61, and which is arranged to prevent the rotation of latch 61 in the open direction (counterclockwise direction in FIG. 2) by engaging with an outer circumference of latch 61.

Open lever 9 is disposed on the front surface side of first base portion 421. Open lever 9 is fixed on supporting shaft 8 to rotate as a unit with ratchet 62. Outside lever 10 is located in a lower position of base plate 42, on the front surface side of first base portion 421, nearer to the inner edge of base plate 42 than to the outer edge of base plate 42 in the lateral direction of the vehicle. Outside lever 10 is pivotably supported by a supporting shaft 15 extending in the forward and rearward directions. Outside lever 10 includes a connection portion 101 located at an end portion of outside lever 10 directing toward the outside of the vehicle, and connected with a lower end portion of inner cable 142 of Bowden cable 14.

When outside handle 13 is operated to open the door, the operating force is transmitted through inner cable 142 to connection portion 101 of outside lever 10. Outside lever 10 is pivoted a predetermined angle by the operating force against an urging force of a spring (not shown) in the counterclockwise direction from a non-activation position shown by a solid line of FIG. 1. An intermediate step portion 10*a* of outside lever 10 is engaged with a bend shoulder portion 12*a* of second sub lever 12, and outside lever 10 is moved to an activation position shown by a two-dotted chain line of FIG. 1. First and second sub levers 11 and 12 are moved in the upward direction in response to the movement of outside lever 10 to the activation position. A bent portion 12*b* of second sub lever 12 is abutted on a lower edge 9*a* of open lever 9. Consequently, open lever 9 is pivoted in a release direction (clockwise direction in FIG. 1) to release or detach ratchet 62 from latch 61, so that door 2 can be opened.

First and second sub levers 11 and 12 are supported to be moved in the upward and downward directions and pivoted a predetermined angle in the forward and rearward directions by the inside lever and the other levers (not shown) supported by second base portion 422. These structures do not relate to the present invention, and these drawings are omitted.

Connection portion 101 of outside lever 10 is positioned at a position which is obliquely below supporting shaft 15 between supporting shaft 15 and the outer edge of base plate 42 in the lateral direction (on the right side of supporting shaft 15 in FIG. 1), and which is within engagement region B in region A when outside lever 10 is in the non-activation position as shown in the front view of FIG. 1. Moreover, connection portion 101 of outside lever 10 is moved within engagement region B without deviating from engagement region B when outside lever 10 is pivoted to the activation position. Preferably, the entire portions of outside lever 10 including connection portion 101 are located and moved within engagement region B.

As mentioned above, for example, an external load acts to door 2 by a side impact (collision) and so on, and consequently outer door panel 2A is deformed to the inside (left side in FIG. 1) of the vehicle. In this door deformation, outer door panel 2A abuts on the outer edge (on the right side in FIG. 1) of base member 4 which is tightly or strongly fixed to door 2 by the plurality of bolts 3A~3C, and consequently the further deformation is prevented. Accordingly, the external load is received by base member 4. The external load does not act directly to outside lever 10 positioned within engagement region B of region A, and cable fixing portion 421*a* in which pipe 141 of Bowden cable 14 is fixed. Therefore, it is possible to prevent outer door panel 2A from conflicting with outside lever 10, and to prevent the deformation and the mechanical malfunction of outside lever 10. Moreover, it is possible to prevent the deformation of cable fixing portion 421*a* and Bowden cable 14.

Specifically, both sides of engagement region B are fixed to door 2 by bolts 3A~3C, and engagement region B has a relatively high strength. Accordingly, it is possible to effectively prevent the external load from directly acting to outside lever 10.

Even in a case in which outer door panel 2A is deformed and abutted on the outer edge (on the right side in FIG. 1) of base member 4, the entire portions of outside lever 10 including connection portion 101 can be moved within engagement region B in region A without deviating from engagement region B. Accordingly, it is possible to pivot outside lever 10 to avoid the interference with outer door panel 2A by the operation of the outside handle 13, and to release the engagement of engagement mechanism 6.

In the apparatus according to the embodiment of the present invention, the door latch apparatus for the vehicle, the door latch apparatus includes: the base member 4 fixed in the door by a plurality of bolts (3A~3C), the base member having the surface extending in the lateral direction of the vehicle from the outer edge to the inner edge; the engagement mechanism 6 supported by the base member 4, and arranged to be engaged with the striker 5 of the vehicle body; and an outside lever 10 pivotably supported by the base member 4, and connected through the operating force transmitting member 14 to the outside handle 13 provided to the outer door panel 2A of the door 2, the outside lever 10 being pivoted in accordance with the operation of the outside handle so as to release the engagement between the engagement mechanism 6 and the striker 5, the outside lever 10 including a connection portion 101 connected with the operating force transmitting member 14, and disposed in the region inside of the outer edge of the base member 4 in the lateral direction of the vehicle.

In this structure, even when the outer door panel is deformed to the inside of the vehicle by the external load to the door, this deformation is suppressed by the base member fixed to the door. Therefore, the external load does not acts directly to the connection portion of the outside lever disposed in the region of the base member. Accordingly, it is possible to prevent the mechanical malfunction of the outside lever.

In the apparatus according to the embodiment of the present invention, the base member 4 includes the outer engagement portion 42*c* which is located nearer to the outer edge of the base member 4 than to the inner edge of the base member 4 in the lateral direction of the vehicle, and into which one of the bolts 3C is screwed, and the inner engagement portion (42*a*, 42*b*) which is located nearer to the inner edge of the base member 4 than to the outer edge of the base member 4 in the lateral direction of the vehicle, and into which one of the bolts (3A, 3B) is screwed; and the region is a region between the outer engagement portion 42*c* and the inner engagement portion (42*a*, 42*b*) in the lateral direction of the vehicle.

In this structure, the region between the outer engagement portion and the inner engagement portion of the base member has a relatively high strength since the both sides of the region are fixed to the door by the bolts. Accordingly, it is possible to surely prevent the external load from directly acting to the connection portion of the outside lever.

In the apparatus according to the embodiment of the present invention, the outside lever 10 is located nearer to the inner edge of the base member 4 than to the outer edge of the base member 4 in the lateral direction of the vehicle; and the connection portion 101 of the outside lever 10 is moved without deviating from the region when the outside lever 10 is pivoted in accordance with the operation of the outside handle 13.

Accordingly, it is possible to prevent the interference of the deformed outer door panel to the connection portion, and to surely pivot the outside lever on the basis of the operation of the outside handle.

In the apparatus according to the embodiment of the present invention, the entire portions of the outside lever 10 including the connection portion 101 are located within the region.

Accordingly, it is possible to prevent the external load from directly acting to the entire portions of the outside lever.

In the apparatus according to the embodiment of the present invention, the operating force transmitting member 14 is the Bowden cable including the inner cable 142 connected with the connection portion 101 of the outside lever 10, and the pipe 141 into which the inner cable 142 is inserted; and the end portion of the pipe 141 is fixed to the cable fixing portion 421*a* provided to the base member 4 in the region.

Accordingly, it is possible to prevent the deformation of the cable fixing portion by the external load, and to surely transmit the operating force of the outside handle to the outside lever.

This application is based on a prior Japanese Patent Application No. 2007-168382. The entire contents of the Japanese Patent Application No. 2007-168382 with a filing date of Jun. 27, 2007 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A door latch apparatus for a vehicle, the door latch apparatus comprising:

a base member fixed in a door, the base member having a surface extending in a lateral direction of the vehicle from an outer edge to an inner edge;

an engagement mechanism mounted to the base member, and arranged to be engaged with a striker of a vehicle body;

an open lever which is located nearer to the inner edge of the base member than to the outer edge of the base member in the lateral direction of the vehicle, the open lever being operatively connected to the engagement mechanism for disengaging the engagement mechanism from the striker to open the door;

a sub lever which is located nearer to the inner edge of the base member than to the outer edge of the base member in the lateral direction of the vehicle, and which is arranged to be abutted on the open lever; and an outside lever pivotably mounted to the base member, and connected through an operating force transmitting member to an outside handle provided to an outer door panel of the door, the outside lever being pivoted in accordance with an operation of the outside handle so as to move the sub lever to abut the open lever and release the engagement between the engagement mechanism and the striker, the outside lever including a connection portion connected with the operating force transmitting member, wherein the base member comprises a first threaded hole located nearer to the outer edge of the base member than to the inner edge of the base member and a second threaded hole located nearer to the inner edge of the base member than to the outer edge of the base member, the first and second threaded holes being adapted to receive a bolt to secure the base member to the door, wherein the base member defines a region between the first and second threaded holes, and the connection portion is disposed within the region such that the outside lever is protected when an impact force is applied to the outer door panel.

2. The door latch apparatus as claimed in claim 1, wherein the outside lever is located nearer to the inner edge of the base member than to the outer edge of the base member in the lateral direction of the vehicle; and the connection portion of the outside lever is configured to move without deviating from the region when the outside lever is pivoted in accordance with the operation of the outside handle.

3. The door latch apparatus as claimed in claim 1, wherein entire portions of the outside lever including the connection portion are located within the region.

4. The door latch apparatus as claimed in claim 1, wherein the operating force transmitting member is a Bowden cable including an inner cable connected with the connection portion of the outside lever, and a pipe into which the inner cable is inserted; and an end portion of the pipe is fixed to a cable fixing portion provided to the base member in the region.

* * * * *